US010337169B2

(12) United States Patent
Pfaff et al.

(10) Patent No.: US 10,337,169 B2
(45) Date of Patent: Jul. 2, 2019

(54) MID MOUNT STABILIZER FOR A BACKHOE LOADER

(71) Applicant: Deere & Company, Moline, IL (US)

(72) Inventors: Wylie C. Pfaff, Dubuque, IA (US); Scott S. Hendron, Dubuque, IA (US); Robert C. Moore, Dubuque, IA (US); Martti Johannes Lampela, Newbury Park, CA (US); John William Krieger, Newbury Park, CA (US); Peter Fraser Falt, Newbury Park, CA (US); Michael McLaughlin, Newbury Park, CA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 15/447,851

(22) Filed: Mar. 2, 2017

(65) Prior Publication Data

US 2018/0251954 A1 Sep. 6, 2018

(51) Int. Cl.

| | |
|---|---|
| ***B62D 61/00*** | (2006.01) |
| ***E02F 9/08*** | (2006.01) |
| *E02F 3/96* | (2006.01) |

(52) U.S. Cl.

CPC ..... *E02F 9/085* (2013.01); *E02F 3/964* (2013.01)

(58) Field of Classification Search

CPC ..... E02F 9/085; E02F 9/08; E02F 9/10; E02F 9/00; E02F 9/0841; E02F 3/964; E02F 3/96; E02F 3/38; E02F 3/30; E02F 3/28; E02F 3/34; E02F 3/32; E02F 3/36; B60S 9/00; B60S 9/02; B60S 9/10; B60S 9/14; B60S 9/22; B66C 23/00; B66C 23/78; B66C 23/80

See application file for complete search history.

(56) References Cited

U.S. PATENT DOCUMENTS

| | | | | | |
|---|---|---|---|---|---|
| 3,235,280 | A * | 2/1966 | Aage | B60P 1/022 | 180/313 |
| 3,543,956 | A * | 12/1970 | Furuno | B60P 1/30 | 414/718 |
| 3,596,735 | A * | 8/1971 | Denier | B66F 11/042 | 182/148 |
| 3,802,720 | A * | 4/1974 | Ellis | B60R 21/131 | 280/755 |
| 3,955,695 | A * | 5/1976 | Maurer | B60S 9/10 | 212/292 |
| 4,082,197 | A * | 4/1978 | Stedman | B66F 9/0655 | 212/264 |

(Continued)

*Primary Examiner* — James M Dolak

(57) ABSTRACT

A stabilizer device for a work vehicle. The work vehicle having a first ground-engaging device having a first midpoint and a second ground-engaging device having a second midpoint. The first ground-engaging device and the second ground-engaging device configured to move the work vehicle along a surface. The stabilizer device comprising a mount coupled to the work vehicle between the first ground-engaging device and the second ground-engaging device. A stabilizer bar coupled to the mount. An actuator coupled to the mount and the stabilizer bar and configured to raise the stabilizer bar from a ground-engaging position to a stowed position. The stabilizer device extends to one of equal to and beyond the second midpoint in the ground-engaging position.

5 Claims, 7 Drawing Sheets

(56) References Cited

U.S. PATENT DOCUMENTS

| | | | | |
|---|---|---|---|---|
| 4,360,311 | A * | 11/1982 | Dufour | E02F 9/024 180/41 |
| 4,401,408 | A | 8/1983 | Gibert | |
| 4,531,882 | A | 7/1985 | Gibert | |
| 4,848,012 | A | 7/1989 | Zimmerman | |
| 6,176,458 | B1 * | 1/2001 | Stryke | B60P 1/00 248/351 |
| 6,705,644 | B2 * | 3/2004 | States | B66C 23/80 280/764.1 |
| 6,715,579 | B1 * | 4/2004 | Hendron | E02F 9/0841 212/302 |
| 7,383,906 | B2 * | 6/2008 | Sewell | B66F 9/0655 180/89.12 |
| 10,077,171 | B2 * | 9/2018 | Chustz | B66C 15/06 |

* cited by examiner

MID MOUNT STABILIZER FOR A BACKHOE LOADER

FIELD OF THE DISCLOSURE

The present disclosure generally relates to work vehicles, and more particularly to a device and method for a stabilizer device for a work vehicle.

BACKGROUND OF THE DISCLOSURE

In order to stabilize a work vehicle, larger rear wheels and stabilizers mounted rearward of the larger rear wheels are commonly used in work vehicles.

SUMMARY OF THE DISCLOSURE

In one embodiment, a stabilizer device for a work vehicle is disclosed. The work vehicle having a first ground-engaging device having a first midpoint and a second ground-engaging device having a second midpoint. The first ground-engaging device and the second ground-engaging device configured to move the work vehicle along a surface. The stabilizer device comprising a mount coupled to the work vehicle between the first ground-engaging device and the second ground-engaging device. A stabilizer bar is coupled to the mount. An actuator is coupled to the mount and the stabilizer bar and configured to raise the stabilizer bar from a ground-engaging position to a stowed position. The stabilizer device extends to one of equal to and beyond the second midpoint in the ground-engaging position.

In another embodiment, a work vehicle is disclosed. The work vehicle comprises an operator's station. A first ground-engaging device having a first midpoint is provided. The first midpoint is positioned forwardly of the operator's station. A second ground-engaging device having a second midpoint is provided. The second midpoint is positioned rearwardly of the operator's station. A stabilizer device comprises a mount coupled to the work vehicle between the first midpoint and the second midpoint. A stabilizer bar is coupled to the mount. An actuator is coupled to the stabilizer bar and positioned between the first midpoint and the second midpoint and configured to raise the stabilizer bar from a ground-engaging position to a stowed position. The stabilizer device extends beyond the second midpoint in the ground-engaging position.

In yet another embodiment, a method for stabilizing a work vehicle is disclosed. The work vehicle having a first ground-engaging device having a first midpoint and a second ground-engaging device having a second midpoint. The first ground-engaging device and the second ground-engaging device configured to move the work vehicle along a surface. The method comprising providing a stabilizer device that extends from between the first midpoint and the second midpoint to beyond the second midpoint in a ground-engaging position. The method further comprises lowering the stabilizer device from a stowed position to the ground-engaging position to stabilize the work vehicle.

Other features and aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

DETAILED DESCRIPTION

Figure 1:
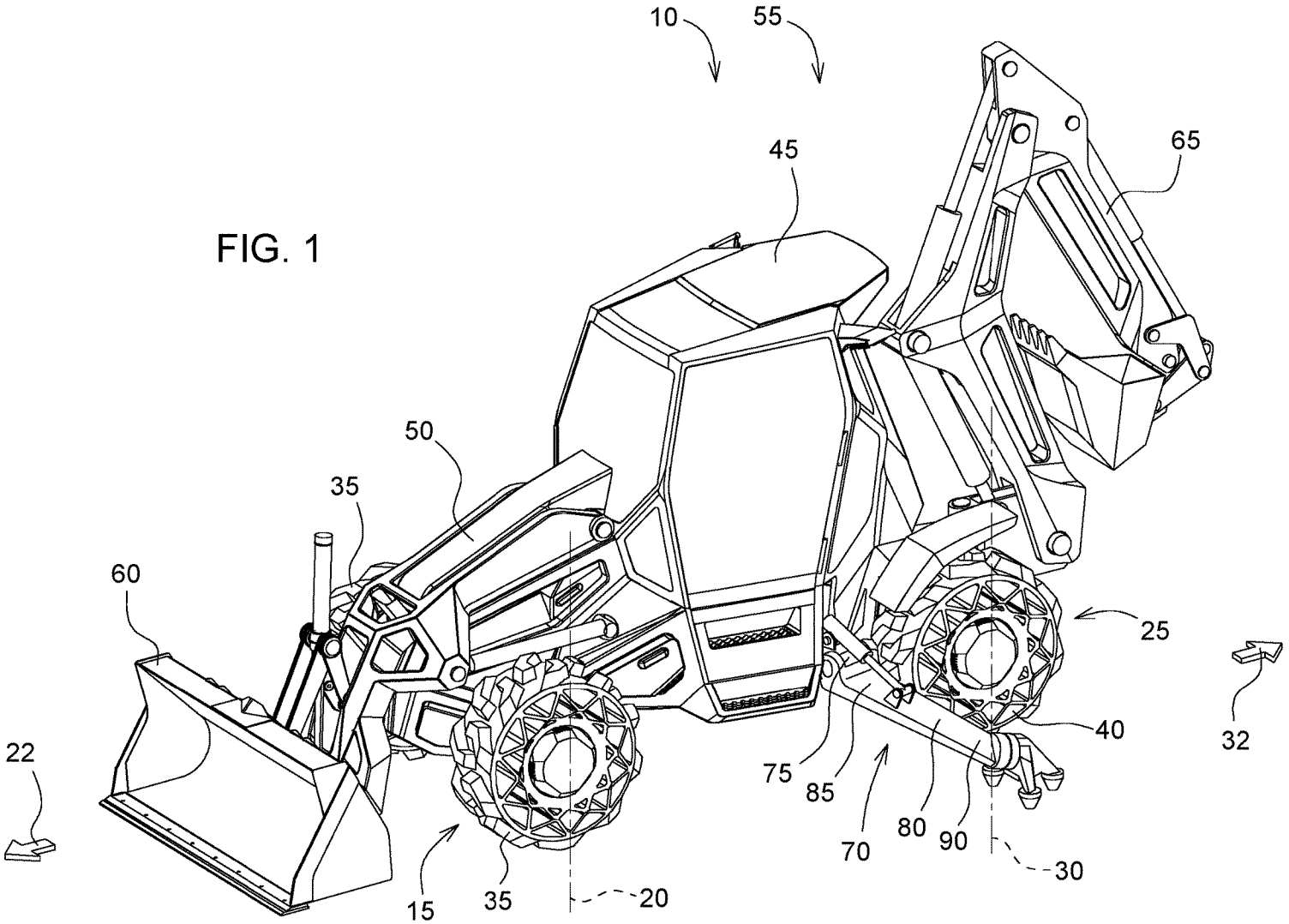
FIG. 1 is a perspective view of a work vehicle according to one embodiment with a stabilizer device in a ground-engaging position.

FIG. 1 illustrates a work vehicle 10 supported by a first ground-engaging device 15 having a first midpoint 20 and a second ground-engaging device 25 having a second midpoint 30. The first and second ground-engaging devices 15, 25 are configured to move the work vehicle 10 along a surface. The illustrated first ground-engaging device 15 is a first pair of wheels 35. The illustrated second ground-engaging device 25 is a second pair of wheels 40. The first and second pair of wheels 35, 40 may be the same size and may share an approximately equal distribution of weight of the work vehicle 10. Alternatively, the first and second ground-engaging devices 15, 25 may be tracks (not shown).

The work vehicle 10 includes an operator's station 45. The first midpoint 20 may be positioned forwardly 22 of the operator's station 45. The second midpoint 30 may be positioned rearwardly 32 of the operator's station 45.

The work vehicle 10 may be powered by an engine 50 that is coupled to a transmission (not shown) for transferring power to the first ground-engaging device 15 and the second ground-engaging device 25. The engine 50 may be a diesel engine. Alternatively, the first and second ground-engaging devices 15, 25 may be powered by electric motors (not shown).

The illustrated work vehicle 10 is a backhoe 55. The work vehicle 10 may include a bucket 60 coupled to the work vehicle 10 forwardly 22 of the operator's station 45. The work vehicle 10 may include a boom 65 coupled to the work vehicle 10 rearwardly 32 of the operator's station 45. The boom 65 may pivot perpendicular to the rearwardly direction 32 towards either of the second pair of wheels 40. Thus, the boom 65 may pivot approximately 180 degrees.

The work vehicle 10 includes a stabilizer device 70. The stabilizer device 70 may be provided on each side of the work vehicle 10 (see FIG. 5). A mount 75 is coupled to the work vehicle 10 between the first ground-engaging device 15 and the second ground-engaging device 25. Alternatively, the mount 75 may be coupled to the work vehicle between the first midpoint 20 and the second midpoint 30.

Figure 2:
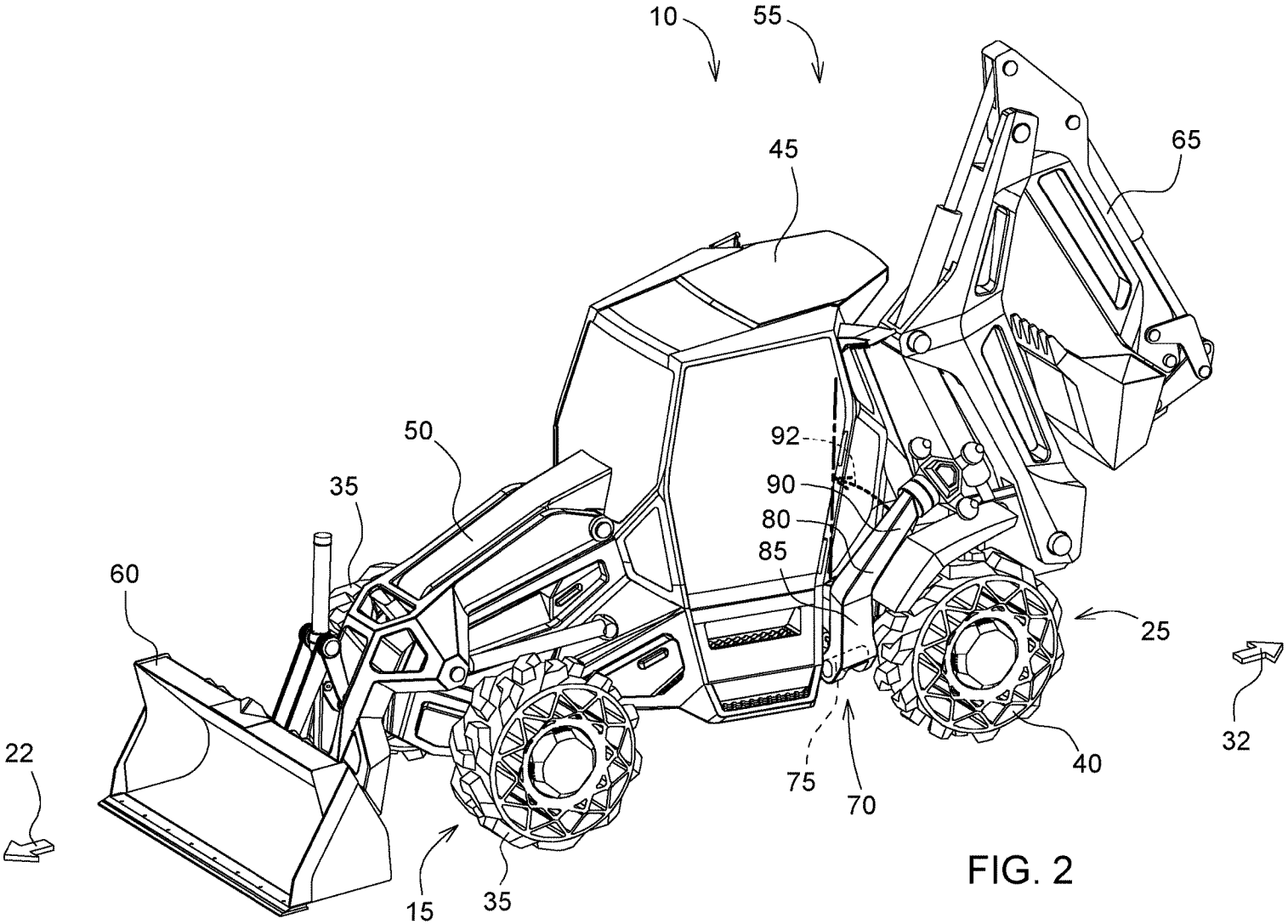
FIG. 2 is a perspective view of the work vehicle of FIG. 1 with the stabilizer device in a stowed position.

With reference to FIG. 2, a stabilizer bar 80 is coupled to the mount 75. The stabilizer bar 80 may comprise a first portion 85 and a second portion 90. The second portion 90 may be positioned at an angle 92 relative to the first portion 85.

Figure 3:
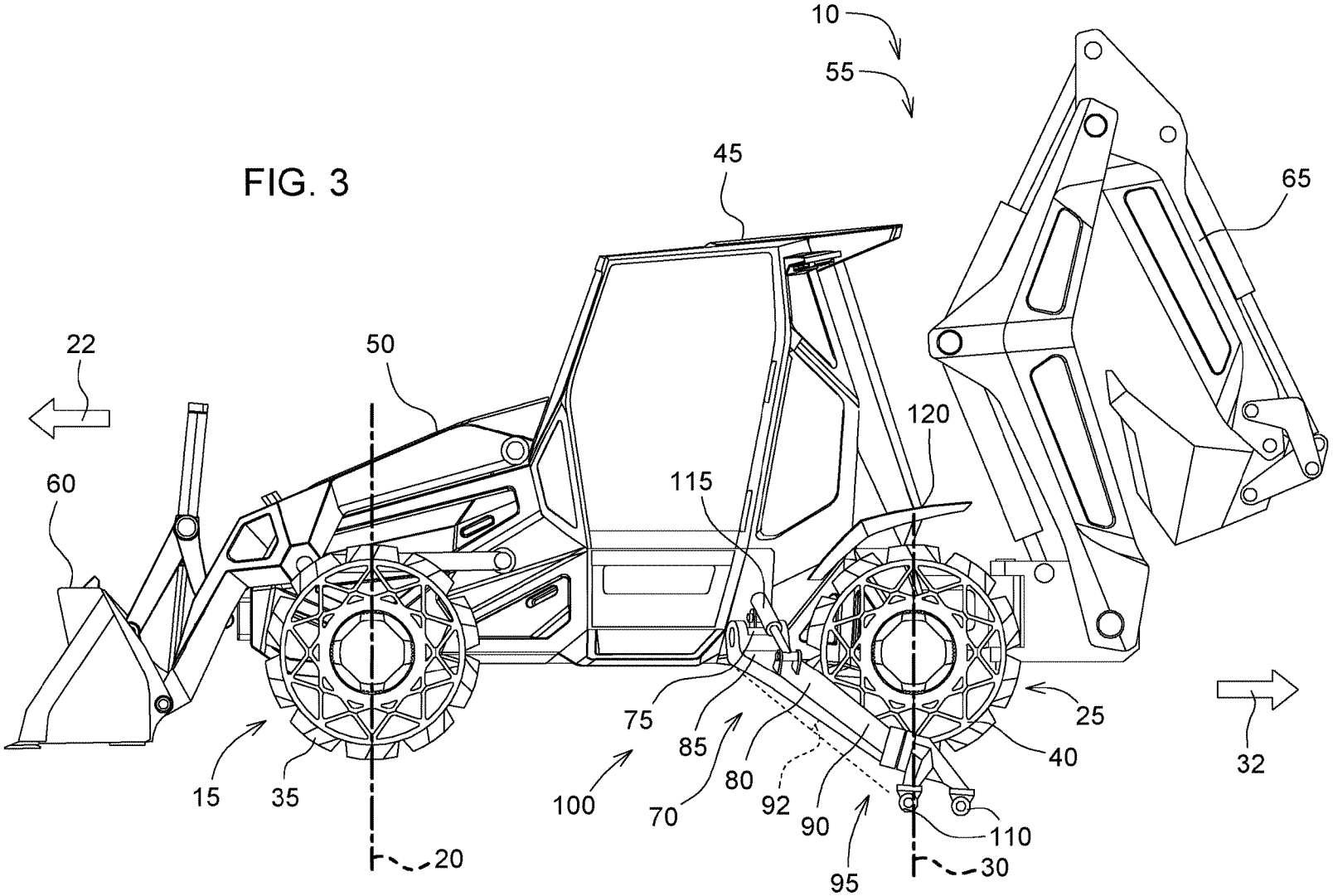
FIG. 3 is a side view of a work vehicle according to another embodiment with a stabilizer device in a ground-engaging position.
Figure 4:
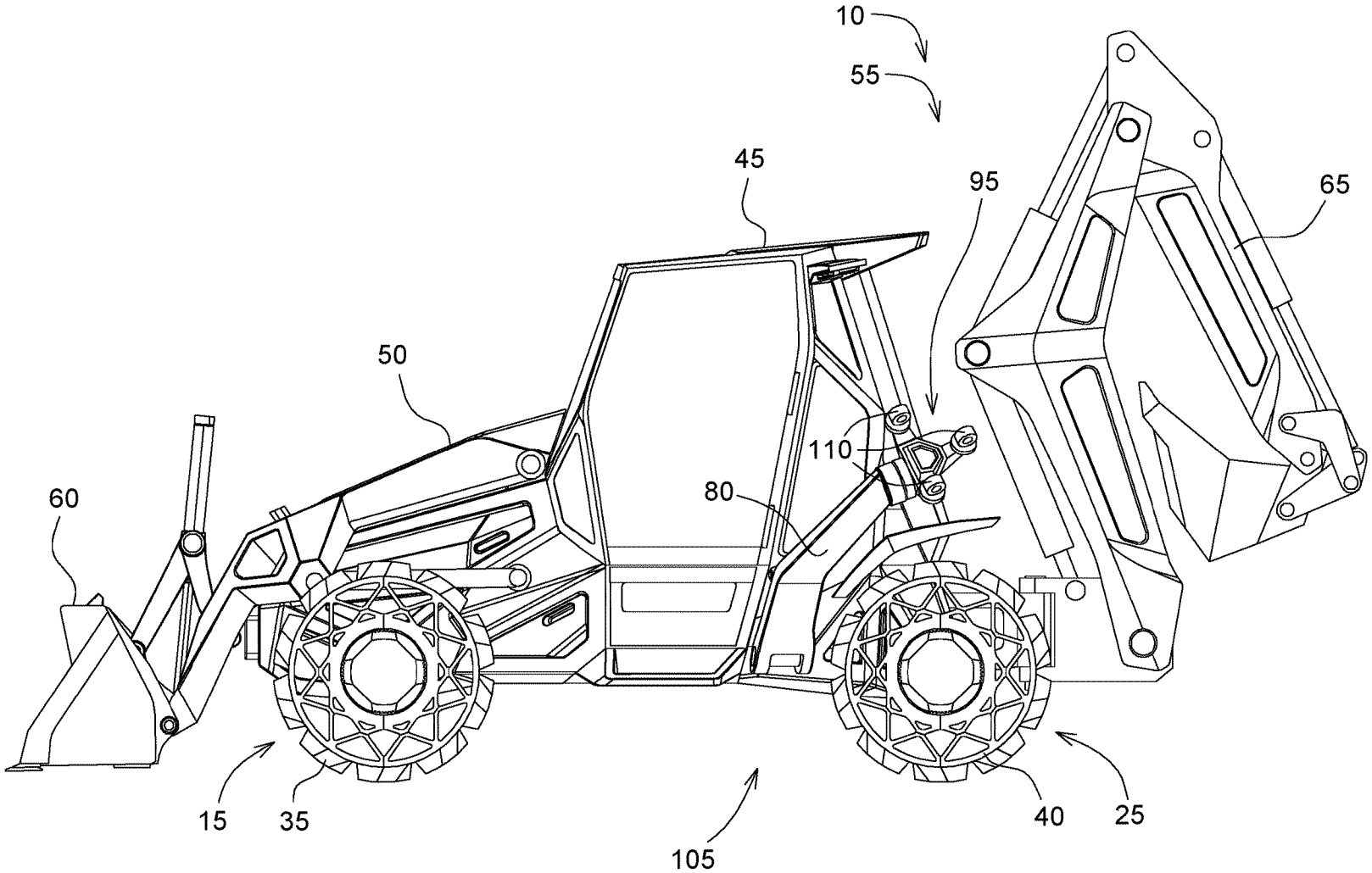
FIG. 4 is a side view of the work vehicle of FIG. 3 with the stabilizer device in a stowed position.

Referring to FIGS. 3 and 4, the stabilizer bar 80 may include a third ground-engaging device 95 configured to move the work vehicle 10 along a surface when the stabilizer bar 80 is in a ground-engaging position 100 (FIG. 3) but not in the stowed position 105 (FIG. 4). The illustrated third ground-engaging device 95 may be a third arrangement of wheels 110 or tracks (not shown). The third arrangement of wheels 110 may be powered by electric motors or hydraulic motors (not shown). The stabilizer bar 80 is configured to reach around the second ground-engaging device 25 and contact the surface in the ground-engaging position 100 (see FIG. 6).

With continued reference to FIG. 3, an actuator 115 is coupled to the mount 75 and the stabilizer bar 80 and is configured to raise the stabilizer bar 80 from the ground-engaging position 100 to the stowed position 105. Alternatively, the actuator 115 may be coupled to the stabilizer bar 80 and the work vehicle 10 between the first midpoint 20 and the second midpoint 30.

Figure 5:
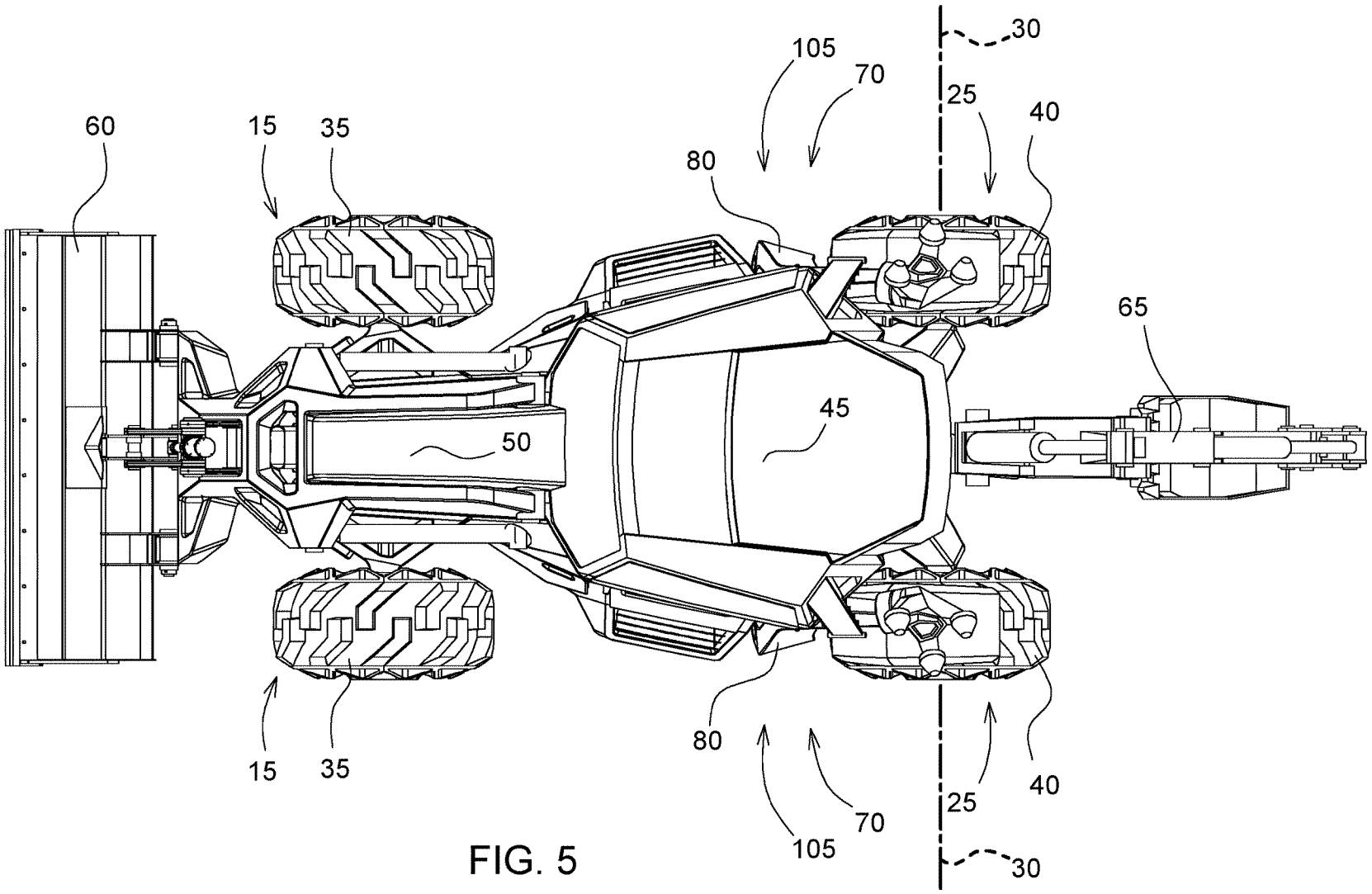
FIG. 5 is a top view of the work vehicle of FIG. 1 with the stabilizer device in the stowed position.
Figure 6:
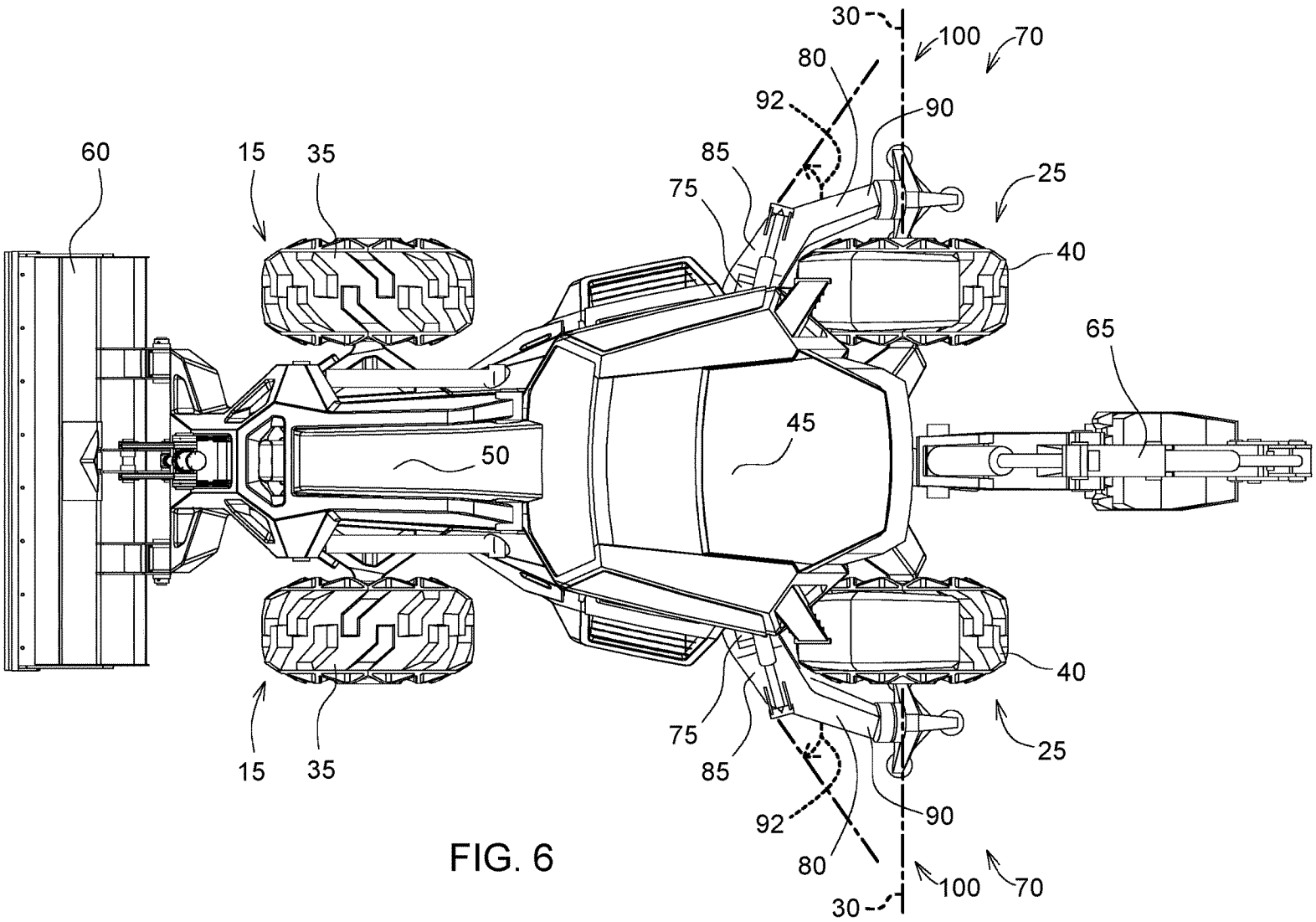
FIG. 6 is a top view of the work vehicle of FIG. 1, with the stabilizer device in the ground-engaging position.

Referring to FIGS. 5 and 6, the stabilizer bar 80 and/or the third ground-engaging device 95 may extend equal to or aligned with the second midpoint 30. Alternatively, the stabilizer bar 80 and/or the third ground-engaging device 95 may extend rearwardly 32 beyond the second midpoint 30. The stabilizer bar 80 and/or the third ground-engaging device 95 may extend equal to or aligned with an outer perimeter 120 of the operator's station 45 or beyond, rearwardly 32.

Figure 7:
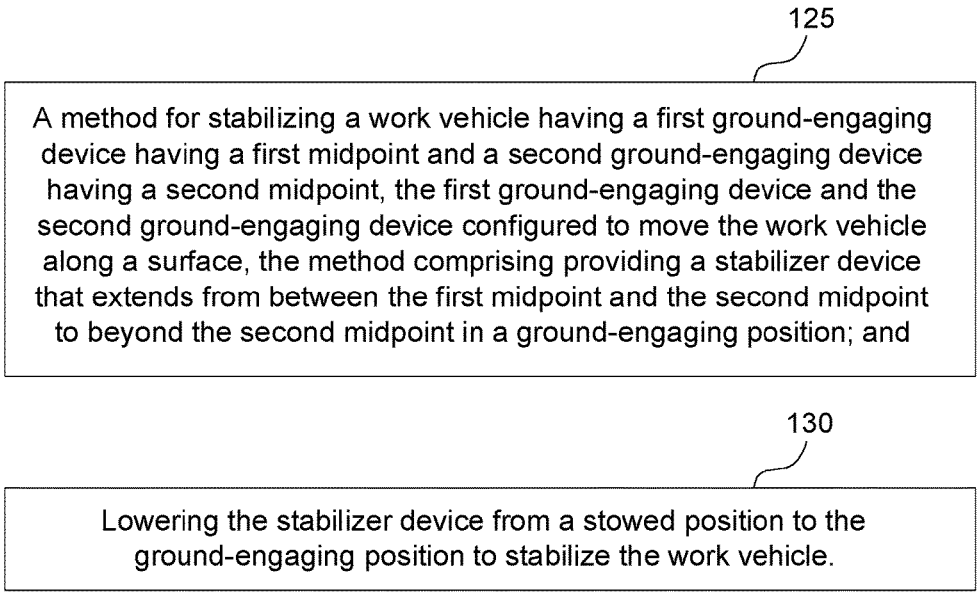
FIG. 7 is a schematic of an illustrative method for stabilizing a work vehicle.

A method for stabilizing a work vehicle 10 is illustrated in FIG. 7. The work vehicle 10 comprising a first ground-engaging device 15 having a first midpoint 20 and a second ground-engaging device 25 having a second midpoint 30. The first and second ground-engaging devices 15, 25 are configured to move the work vehicle 10 along a surface. The illustrated first ground-engaging device 15 is a first pair of wheels 35. The illustrated second ground-engaging device 25 is a second pair of wheels 40. The first and second pair of wheels 35, 40 may be the same size and may share an equal distribution of weight of the work vehicle 10. Alternatively, the first and second ground-engaging devices 15, 25 may be tracks.

In Step 125, a stabilizer device 70 is provided that extends from between the first midpoint 20 and the second midpoint 30 to beyond the second midpoint 30 in a ground-engaging position 100. The stabilizer device 70 may comprise a stabilizer bar 80 that may comprise a first portion 85 and a second portion 90. The second portion 90 may be positioned at an angle 92 relative to the first portion 85. A third ground-engaging device 95 may be coupled to the stabilizer device 70 and configured to move the work vehicle 10 along a surface and position the work vehicle 10 at a worksite.

In Step 130, the stabilizer device 70 is lowered from a stowed position 105 to the ground-engaging position 100 to stabilize the work vehicle 10.

Various features are set forth in the following claims.

What is claimed is:

1. A work vehicle comprising:

an operator's station;

a first ground-engaging device having a first midpoint, the first midpoint positioned forwardly of the operator's station;

a second ground-engaging device having a second midpoint, the second midpoint positioned rearwardly of the operator's station; and a stabilizer device comprising:

a mount coupled to the work vehicle between the first midpoint and the second midpoint;

a stabilizer bar coupled to the mount; and an actuator coupled to the stabilizer bar and positioned between the first midpoint and the second midpoint and retracts to raise the stabilizer bar from a ground-engaging position to a stowed position;

wherein the stabilizer device extends beyond the second midpoint in the ground-engaging position the stabilizer bar having a third ground-engaging device comprising at least one wheel for moving the work vehicle along a surface when the stabilizer bar is in the ground-engaging position;

wherein the stabilizer bar comprises a first portion and a second portion, the second portion positioned at a smaller angle relative to a forwardly-rearwardly direction of the work vehicle than the first portion relative to the forwardly-rearwardly direction of the work vehicle in the ground-engaging position.

2. The work vehicle of claim 1, wherein the first ground-engaging device is at least one wheel and the second ground-engaging device is at least one wheel.

3. The work vehicle of claim 1, wherein the first ground-engaging device and the second ground-engaging device are mirrored along a midline of the work vehicle to share an equal distribution of a weight of the work vehicle.

4. The work vehicle of claim 1, wherein the first ground-engaging device and the second ground-engaging device are wheels that are the same size.

5. The work vehicle of claim 1, further comprising a bucket coupled to the work vehicle and positioned forwardly of the operator's station and a boom coupled to the work vehicle and positioned rearwardly of the operator's station.

* * * * *